US011596289B2

(12) United States Patent
Naik et al.

(10) Patent No.: US 11,596,289 B2
(45) **Date of Patent: *Mar. 7, 2023**

(54) DISHWASHER

(71) Applicant: Whirlpool Corporation, Benton Harbor, MI (US)

(72) Inventors: Sujit S. Naik, Pune (IN); Floyd Jackson, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 98 days.

This patent is subject to a terminal disclaimer.

(21) Appl. No.: 17/189,331

(22) Filed: Mar. 2, 2021

(65) Prior Publication Data

US 2021/0177238 A1 Jun. 17, 2021

Related U.S. Application Data

(63) Continuation of application No. 16/232,647, filed on Dec. 26, 2018, now Pat. No. 11,006,813, which is a continuation-in-part of application No. 15/927,377, filed on Mar. 21, 2018, now Pat. No. 10,716,449.

(51) Int. Cl.

| | |
|---|---|
| ***A47L 15/42*** | (2006.01) |
| ***A47L 15/50*** | (2006.01) |
| ***A47L 15/16*** | (2006.01) |

(52) U.S. Cl.

CPC ..... *A47L 15/4282* (2013.01); *A47L 15/16* (2013.01); *A47L 15/50* (2013.01)

(58) Field of Classification Search

CPC ..... A47L 15/4282

See application file for complete search history.

(56) References Cited

U.S. PATENT DOCUMENTS

| | | | |
|---|---|---|---|
| 7,621,286 | B2 | 11/2009 | Frei et al. |
| 9,241,607 | B2 | 1/2016 | Porcaro, II et al. |
| 9,326,657 | B2 | 5/2016 | Thiyagarajan |
| 9,420,938 | B2 | 8/2016 | Forst et al. |
| 9,532,701 | B2 | 1/2017 | Feddema et al. |
| 2007/0158472 | A1 | 7/2007 | Calhoun et al. |
| 2009/0159103 | A1 | 6/2009 | Gillum et al. |
| 2009/0255560 | A1 | 10/2009 | Lehmann et al. |
| 2010/0101611 | A1 | 4/2010 | Chen et al. |
| 2011/0139181 | A1 | 6/2011 | Lee et al. |
| 2013/0255733 | A1 | 10/2013 | Ju et al. |

(Continued)

FOREIGN PATENT DOCUMENTS

| | | |
|---|---|---|
| CN | 101049224 A | 10/2007 |
| CN | 106073675 A | 11/2016 |

(Continued)

OTHER PUBLICATIONS

Chinese Patent Office, Office Action re Corresponding Application No. 201910214399.6, dated Apr. 27, 2021, 9 pages, China.

*Primary Examiner* — Jason Y Ko
(74) *Attorney, Agent, or Firm* — McGarry Bair PC

(57) ABSTRACT

An automatic dishwasher with a treating chamber, at least one dish holder, and a sprayer. The sprayer can be coupled to the dish holder and include a set of fan spray nozzles or a set of jet nozzles. The set of fan spray nozzles or the set of jet nozzles fluidly connect the sprayer and treating chamber. One or more angles in which fluid flows from the set of fan spray nozzles or the set of jet nozzles into the treating chamber can be adjusted.

20 Claims, 8 Drawing Sheets

(56) References Cited

U.S. PATENT DOCUMENTS

| | | | |
|---|---|---|---|
| 2015/0129004 | A1 | 5/2015 | Lee et al. |
| 2015/0201823 | A1 | 7/2015 | Poojary et al. |
| 2015/0245762 | A1 | 9/2015 | Tuller |

FOREIGN PATENT DOCUMENTS

| | | | |
|---|---|---|---|
| CN | 106998989 | A | 8/2017 |
| DE | 2907916 | A1 | 9/1980 |
| EP | 1334687 | A1 | 8/2003 |
| EP | 2192852 | A1 | 6/2010 |
| EP | 3222191 | A1 | 9/2017 |
| KR | 200300795 | Y | 12/2002 |
| KR | 20050068480 | A | 7/2005 |
| WO | 2016206712 | A1 | 12/2016 |

DISHWASHER

CROSS-REFERENCE TO RELATED APPLICATION(S)

This application is a continuation of U.S. patent application Ser. No. 16/232,647, filed Dec. 26, 2018, now U.S. Pat. No. 11,006,813, issued May 18, 2021, which is a continuation-in-part (CIP) of U.S. patent application Ser. No. 15/927,377, filed on Mar. 21, 2018, now U.S. Ser. No. 10/716,499, issued Jul. 21, 2020, entitled Low Profile Rack and Wash Assembly for Dishwasher, which are incorporated herein by reference in their entirety.

BACKGROUND

Contemporary automatic dishwashers for use in a typical household include a tub and upper, lower, and third level racks or baskets for supporting soiled dishes within the tub. A spray system is provided for re-circulating wash liquid throughout the tub to remove soils from the dishes. The spray system can include a variety of sprayers to address different wash zones. The dishwasher can also include a controller that implements a number of pre-programmed cycles of operation to wash dishes contained in the tub.

BRIEF DESCRIPTION

In one aspect, the disclosure relates to a dishwasher comprising a treating chamber for treating dishes, at least one dish holder located within the treating chamber, a stationary sprayer emitting liquid into the treating chamber from a hollow interior defined at least in part by a manifold, the stationary sprayer comprising a set of jet spray nozzles provided on the stationary sprayer with at least some of the jet spray nozzles in the set having different geometries wherein the different geometries of the jet spray nozzles emit a jet spray at different angles relative to the stationary sprayer, and a recirculation circuit fluidly coupling the treating chamber to the stationary sprayer to recirculate liquid from the treating chamber to the stationary sprayer.

DETAILED DESCRIPTION

Figure 1:
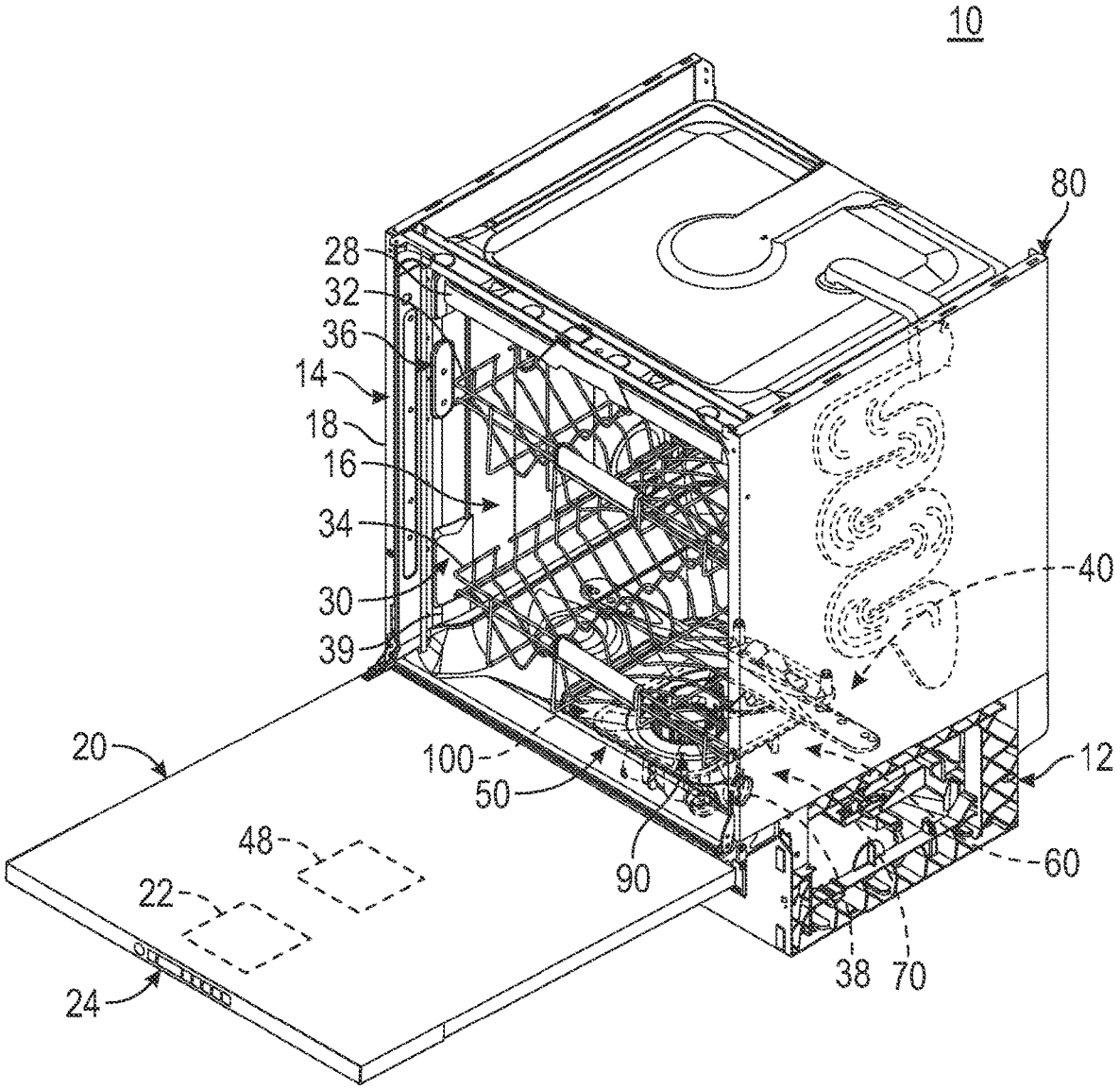
FIG. 1 is a right-side perspective view of an automatic dishwasher having multiple systems for implementing an automatic cycle of operation.

The aspects of the present disclosure are generally directed toward a sprayer for an automatic dishwasher that can include a set of fan spray nozzles or a set of jet spray nozzles. One or more angles in which fluid flows from the set of fan spray nozzles or the set of jet spray nozzles of the sprayer into a treating chamber can be adjusted as described herein.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

While "a set of" various elements will be described, it will be understood that "a set" can include any number of the respective elements, including only one element.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slideably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
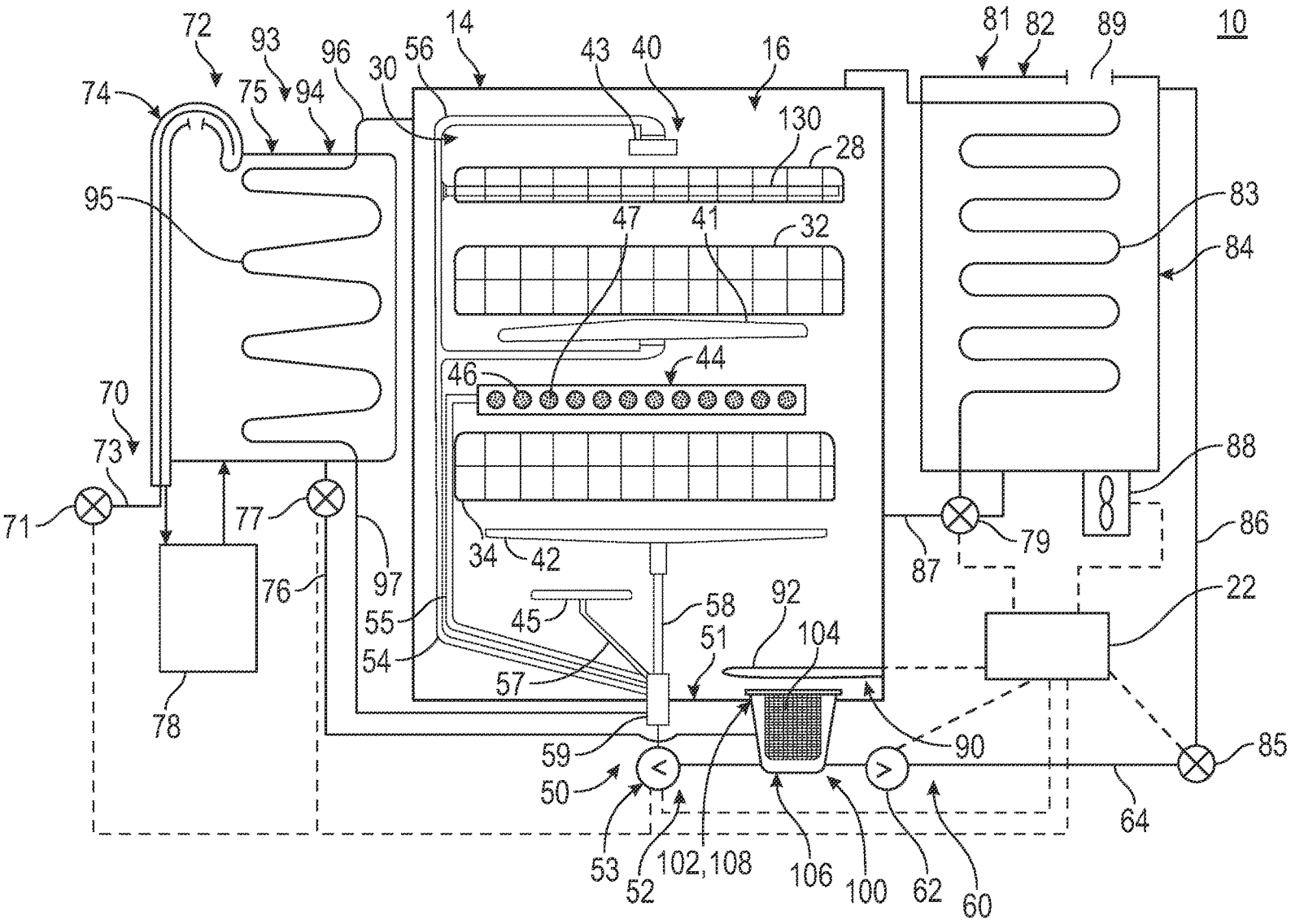
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
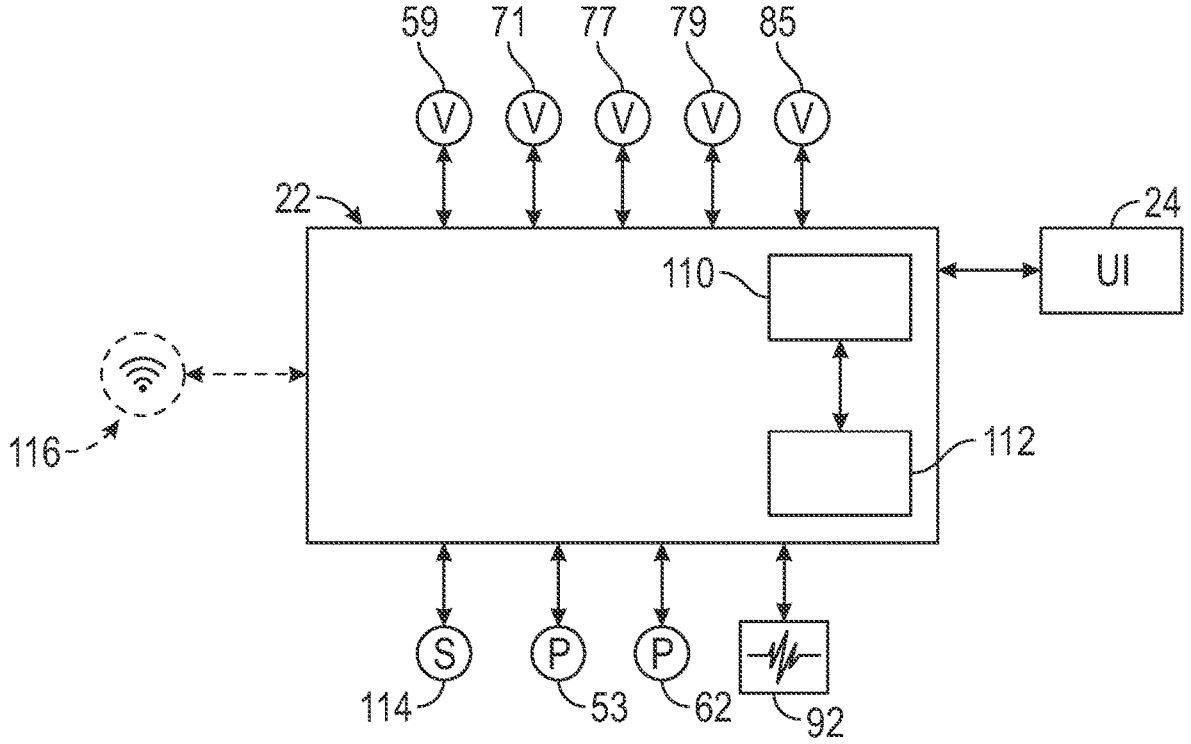
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
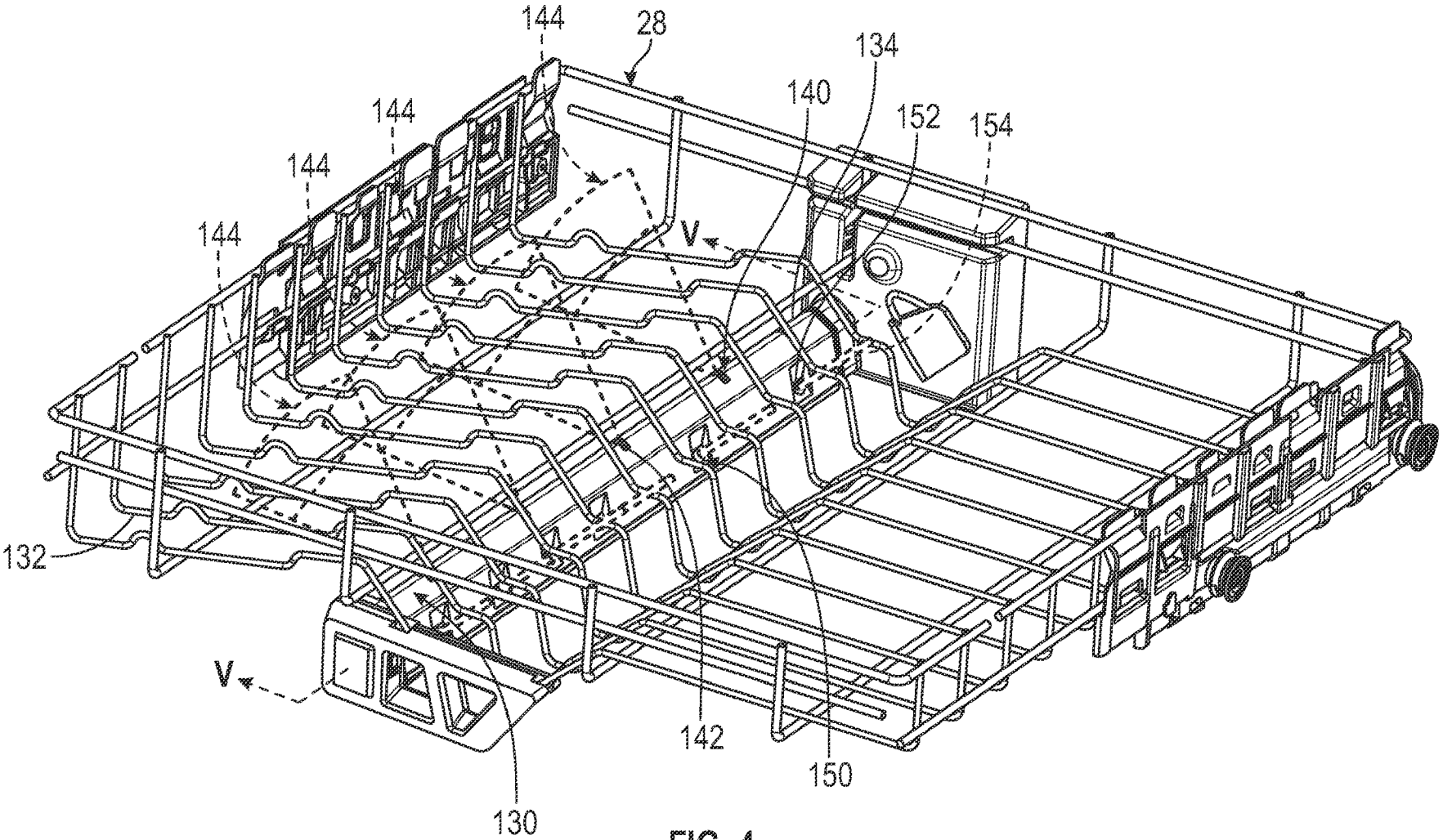
FIG. 4 is a perspective view of a dish holder and a sprayer suitable for use in the automatic dishwasher of FIG. 1.

FIG. 4 is a perspective view of the third level rack or dish holder 28 with the sprayer 130. The dish holder 28 can include wire frame elements 132 forming the rack and defining shapes for retaining dishes. The wire frame elements 132 can be any shape. It is also contemplated that the number of wire frame elements 132 can also vary. The dish holder 28 can include additional structures retaining or shaping devices such as, but not limited to, a utensil basket.

The sprayer 130, as illustrated by way of non-limiting example, can underlie the dish holder 28. As used herein, the term "underlie" can include any location below at least a portion of the wire frame elements 132. Alternatively, the sprayer 130 can be located above at least a portion of the wire frame elements 132 of the dish holder 28. It is contemplated that the sprayer 130 can underlie or be located above the upper dish rack 32 or the lower dish rack 34.

The sprayer 130 is illustrated, by way of non-limiting example, as a non-rotating tube. However, it is contemplated that the sprayer 130 can rotate, such as about a longitudinal axis of the tube. The sprayer 130 can be coupled to the dish holder 28 using any known coupling device or combination of coupling devices such as, but not limited to a clasping mechanism, hot air welding, or bayonet mount. Alternatively, one or more portions of the sprayer 130 can be formed unitarily with one or more components of the dish holder 28.

The sprayer 130 is in the shape of an elongated tube, which defines a manifold 134. A set of fan spray nozzles 140 can be provided on the manifold 134 of the sprayer 130. A slot 142 can be included in each of the set of fan spray nozzles 140 through which liquid can enter the treating chamber 16. A fan spray 144 illustrates, by way of non-limiting example, the general fan shape of the liquid emitted by the slot 142. It is contemplated that the fan spray 144 can cover a variety of areas.

A set of jet nozzles 150 can be provided on the sprayer 130. A jet nozzle outlet 152, as illustrated by way of non-limiting example as a circular opening, can be include in each of the set of jet nozzles 150 through which liquid can enter the treating chamber 16. A jet spray 154 illustrates, by way of non-limiting example, the general shape of the liquid emitted by the set of jet nozzles 150 via the jet nozzle outlet 152, with the jet spray essentially being a stream of liquid. While the jet spray 154 is illustrated as a substantially cylindrical straight line, it is contemplated that the jet spray 154 can include an arcing portion (not shown). It is further contemplated that the jet spray 154 can continue past the illustrated region.

Sprayer nozzles can, in part, be defined by the shape of the liquid emitted from the nozzle. By way of non-limiting example, the fan spray 144 can indicate the presence of the set of fan spray nozzles 140. Similarly, the jet spray 154 can indicate the presence of the jet nozzles 150. While illustrated with both the set of fan spray nozzles 140 and the set of jet nozzles 150, it is contemplated that the sprayer 130 can include any number of fan spray nozzles or jet nozzles. The sprayer 130 can include additional nozzles such as, but not limited to, hollow cone nozzles or misting nozzles.

Figure 5:
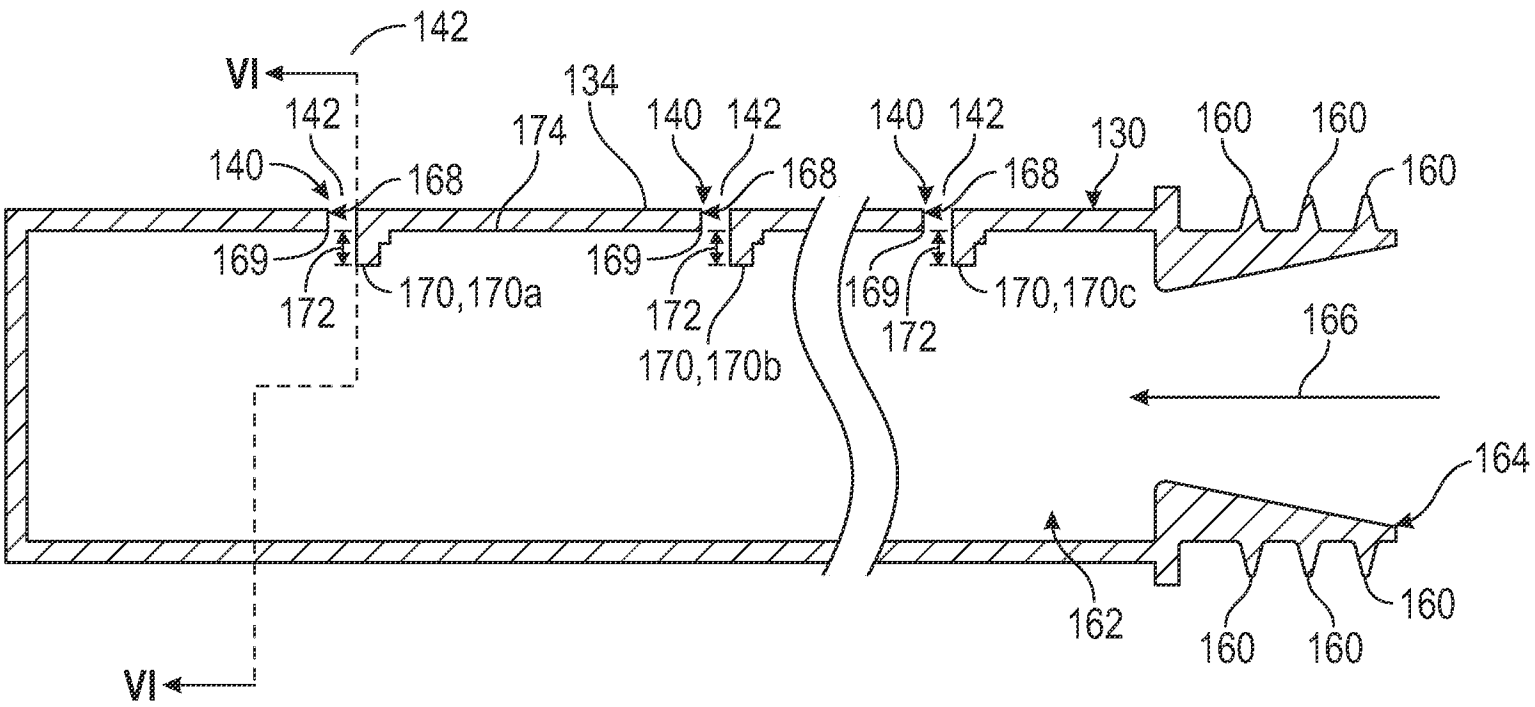
FIG. 5 is a longitudinal cross-sectional view of the sprayer taken along the line V-V of FIG. 4.

FIG. 5 illustrates a generally longitudinal cross-sectional view of the sprayer 130 removed from the dish holder 28 of FIG. 4. Seals 160 are provide on an inlet end 164 of the sprayer 130. The seals cooperate with a complementary seal structure on the conduit 56 to fluidly seal the sprayer 130 to the conduit 56 when the third level rack 28 is slid within the treating chamber 16.

The manifold 134 defines a hollow interior 162. A flow direction 166 can be defined by direction in which liquid flows from the inlet end 164 through the hollow interior 162. In this view, it can be seen that the fan spray nozzles 140 include one or more ribs 170 located upstream of the corresponding slot 142. The ribs 170 can protrude into the hollow interior 162. The ribs 170 protruding into the hollow interior 162 change the velocity of the liquid as it moves in the flow direction 166. A change in velocity of a liquid indicates a change in at least one of the speed or direction of the liquid. It is contemplated that each slot 142 can have more than one corresponding rib. It is further contemplated that the location of the one or more rib 170 can be at any location upstream to the slot 142.

It is contemplated that a side portion 168 can couple to the tube wall 174 at a corner 169. The corner 169 can be a sharp edge where the term "sharp edge" is used to define an intersection that results substantially at a point. It is further contemplated that the side portion 168 or corner 169 can be curved, stepped, sloped or otherwise shaped. It is yet further contemplated that the side portion 168 can be a different thickness than other portions of the manifold 134.

A rib height 172 of the rib 170 can be defined as the greatest distance the rib 170 protrudes from a tube wall 174 into the hollow interior 162. Each of the ribs 170 is illustrated, by way of non-limiting example, as having the rib height 172. It is contemplated that the rib height 172 of the rib 170 can be varied from a first rib 170*a* to a second rib 170*b*. It is further contemplated that some of the ribs can have the same rib height. By way of non-limiting example, the second rib 170*b* can have the same rib height as a third rib 170*c*.

The rib 170 is illustrated, by way of non-limiting example, as having a generally rectangular cross-sectional shape similar to steps. The rib 170 can include sharp edges or curved edges. Optionally, the curved edges can have a radius of curvature of 0.4 millimeters or less. It is contemplated that the rib 170 can have any cross-sectional shape. It is further contemplated rib 170 can include convex or concave portions. It is yet further contemplated, by way of non-limiting example, that the first rib 170*a* and the second rib 170*b* have similar shapes that are different than the third rib 170*c*.

Figure 6:
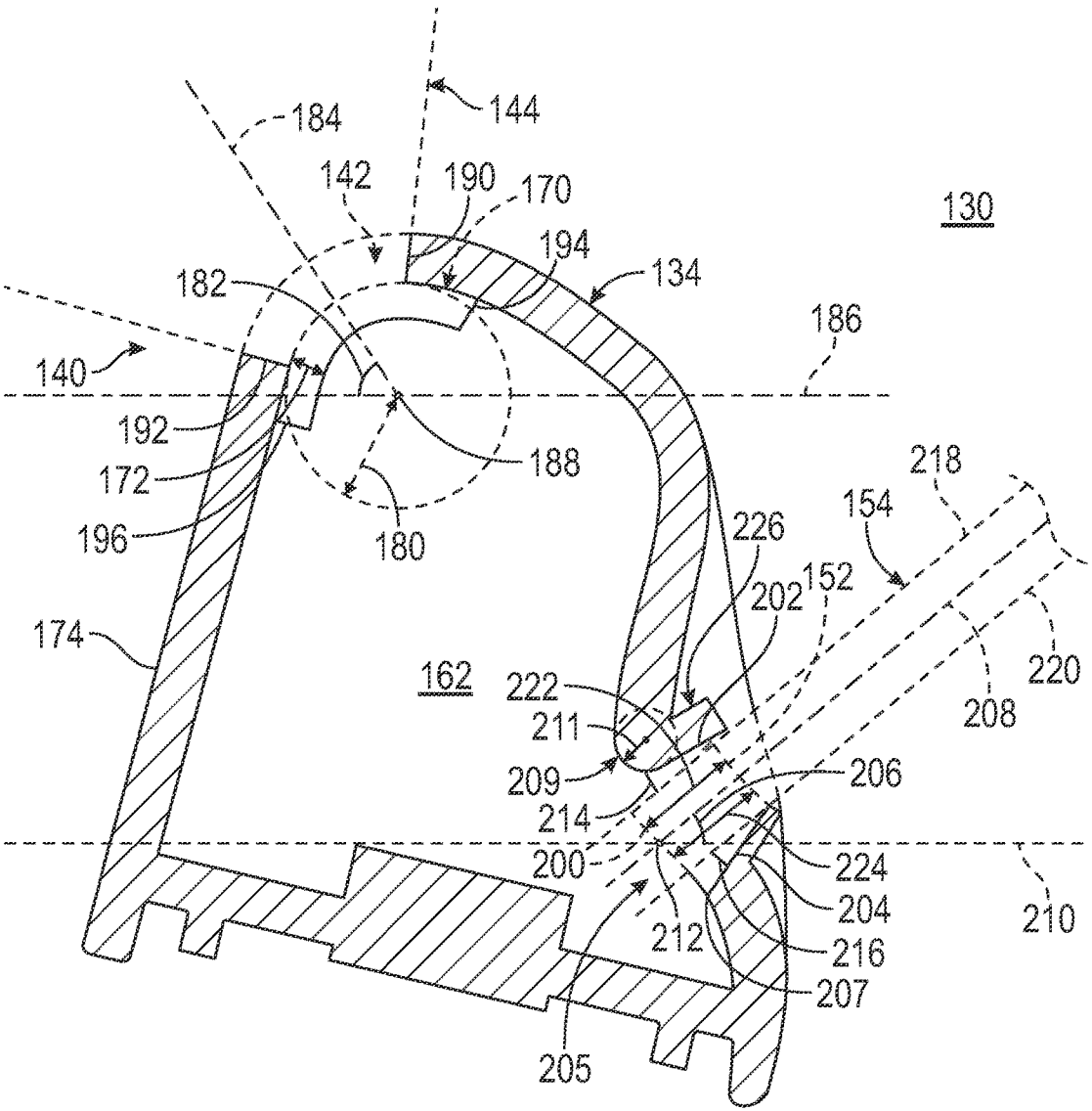
FIG. 6 is a transverse cross-sectional view of the sprayer taken along the line VI-VI of FIG. 5.

FIG. 6 illustrates a generally transverse cross-sectional view of the sprayer 130. The sprayer 130 has a corner defined by a radius of curvature 180. The slot 142 is beneficially located on this corner to provide the slot 142 with a corresponding curvature. Similarly, the rib 170 has a corresponding curvature. The rib 170 defines a fan spray y-angle 182 relative to the center point of the radius of curvature. The fan spray y-angle 182 can be illustrated as the angle between a fan spray centerline 184 and a fan spray reference line 186. The fan spray centerline 184 bisects the fan spray 144 into two equal arc segments. The fan spray reference line 186 is generally horizontal and extends through a center of curvature 188. Alternatively, the fan spray reference line 186 can be any generally horizontal line.

The radius of curvature 180 can, in part, be used to achieve the desired shape or area of the fan spray 144 illustrated by the arcuate cross section of the slot 142. The fan spray y-angle 182 can be adjusted by changing the length of the slot 142, which, when on a corner, is the arc length. For example, the slot 142 can have a first slot side 190 or a second slot side 192. The fan spray y-angle 182 can be adjusted by adding or removing material from the first slot side 190 or the second slot side 192. FIG. 6 also further illustrates the rib 170 as extending from a first rib side 194 to a second rib side 196. As illustrated, by way of non-limiting example, the first rib side 194 can extend beyond the first slot side 190 and the second rib side 196 can extend beyond the second slot side 192. Alternatively, the first rib side 194 or the second rib side 196 can be at or between the first slot side 190 or the second slot side 192.

While the slot is beneficially illustrated on a corner of the sprayer 130, such a corner location is not necessary. The slot could just as well be located on a flat portion of the sprayer 130 along with the rib 170. The corner location is beneficial in the current configuration as it helps control the lower extent of the fan spray to extend along the bottom of the third level rack 28.

Turning attention to the jet nozzles 150, an exemplary jet nozzle 150 is illustrated as a truncated cone, which, when viewed in cross section of FIG. 6 has a jet nozzle inlet 200, a first jet side 202, a second jet side 204, and the jet nozzle outlet 152, which collectively define a jet passage 205 extending from the jet nozzle inlet 200 for fluidly connecting the hollow interior 162 to the treating chamber 16. The second jet side 204 can intersect the tube wall 174 at a sharp jet corner 207 where the sharp jet corner 207 can be, by way of non-limiting example, a sharp edge. The first jet side 202 can intersect the tube wall 174 at a curved jet corner 209 where the curved jet corner 209 can be, by way of non-limiting example, a curved surface. The curved surface of the curved jet corner 209 can have a radius of curvature 211 of 0.4 millimeters or less. It is contemplated that the sharp jet corner 207, the curved jet corner 209, or the corner 169 can be a sharp edge or curved surface with a radius of curvature of 0.4 millimeters of less.

The jet nozzle 150 emits a stream or jet spray that can be described in terms of a jet y-angle 206 defined as the angle between a jet centerline 208 of the jet spray 154 and a jet reference line 210. The jet reference line 210 is generally horizontal and can pass through a jet midpoint 212 that is the midpoint of the jet nozzle inlet 200. Alternatively, the jet reference line 210 can be any generally horizontal line.

The truncated cone defines a first draft angle 214 or a second draft angle 216, which can be used to adjust the jet y-angle 206. The first draft angle 214 can be measured from the first jet side 202 to a first draft reference line 218. Optionally, the first draft reference line 218 can be generally perpendicular to the jet nozzle outlet 152. The second draft angle 216 can be measured from the second jet side 204 to a second draft reference line 220. Optionally, the second draft reference line 220 can be generally perpendicular to the jet nozzle outlet 152 or generally parallel to the first draft reference line 218. It is contemplated that the first draft reference line 218 or the second draft reference line 220 can be parallel with or define at least a portion of the jet spray 154.

As illustrated, by way of non-limiting example of the truncated cone, the first draft angle 214 and second draft angle 216 can be relatively the same. Alternatively, when other geometries are used, such as in a truncated, multi-sided pyramid, the first draft angle 214 and the second draft angle 216 can be the same or at different degrees. While a truncated cone is used for illustration, other geometries are contemplated. However, the jet passage 205 formed by the truncated cone geometry defines a fluidly passage way that is useful in controlling the shape and direction of the emitted jet.

Additionally or alternatively, a first jet height 222 or a second jet height 224 can be used to, at least in part, adjust the jet y-angle 206. The first jet height 222 can be measured from the jet nozzle inlet 200 to the jet nozzle outlet 152 along the first draft reference line 218. The second jet height 224 can be measured from the jet nozzle inlet 200 to the jet nozzle outlet 152 along the second draft reference line 220. As illustrated, by way of non-limiting example, the first jet height 222 and the second jet height 224 can be relatively the same length, especially in a symmetrical geometry like a truncated cone. Alternatively, the first jet height 222 and the second jet height 224 can be different lengths, regardless of whether the geometrical shape is symmetrical or not. The first jet height 222 and the second jet height 224 can be used to determine the shape of a nozzle tip 226, where the nozzle tip 226 can control the jet y-angle 206 of the jet spray 154.

Figure 7:
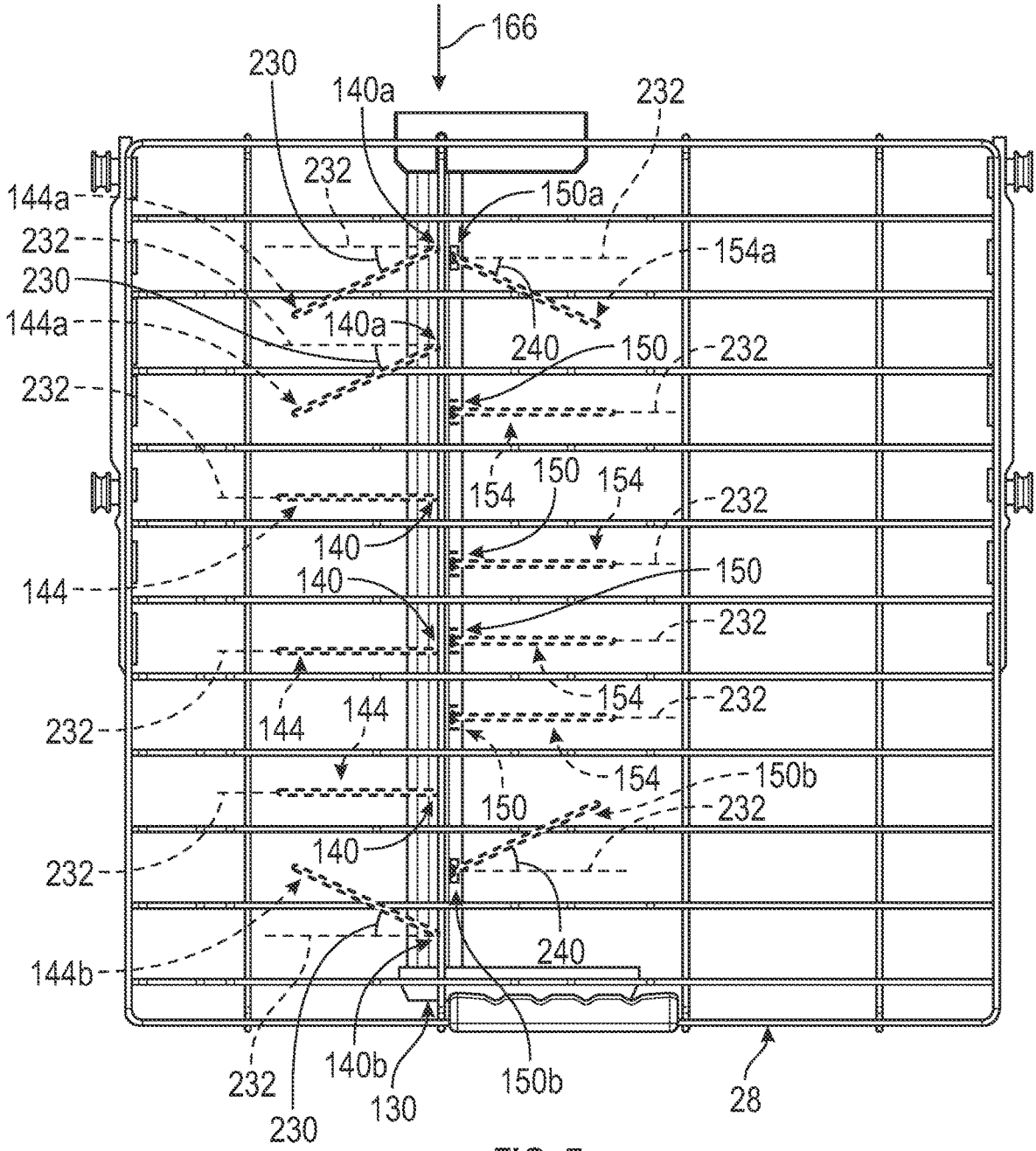
FIG. 7 is a top down view of the dish holder and the sprayer of FIG. 4.

FIG. 7 can further illustrate the direction of the fan spray 144 or the jet spray 154 from a top view of the dish holder 28 and the sprayer 130. The flow direction 166 illustrates the direction of liquid flowing through the hollow interior 162 of the sprayer 130.

Unadjusted fan spray nozzles 140*a* result in the direction of unadjusted fan spray 144*a*. The unadjusted fan spray nozzles 140*a* are fan spray nozzles that do not include the rib 170 as described herein. A fan z-angle 230 can be measured from the direction of the unadjusted fan spray 144*a* to a perpendicular reference line 232. The perpendicular reference line 232 for any nozzle is perpendicular to the sprayer 130 and intersects the nozzle outlet. As illustrated in this example, the fan z-angle 230 of the unadjusted fan spray nozzles 140*a* is approximately 23 degrees. The fan z-angle 230 illustrates that the unadjusted fan spray 144*a* can be at least in part, in the same direction as the flow direction 166.

The fan z-angle 230 for the fan spray nozzles 140 that include the rib 170 as described herein, are relatively close to zero. The fan spray 144 is therefore close to perpendicular to the sprayer 130 or parallel to the corresponding perpendicular reference line 232.

Optionally, a modified fan spray nozzle 140*b* can include the rib 170 to intentionally provide a modified fan spray 144*b* where the fan z-angle 230 can be thought of as, for example, negative 20 degrees. It is important to note that the fan z-angle 230 of the modified fan spray nozzle 140*b* results in the modified fan spray 144*b*, at least in part, in the opposite direction of the flow direction 166.

The presence of the rib 170 changes the velocity of the liquid, which results in a very small (less than 10 degrees) value for the fan z-angle 230. Additionally, or alternatively, the presence of the rib 170 can result in negative values for the fan z-angle 230.

An unadjusted jet nozzle 150*a* results in the direction of an unadjusted jet spray 154*a*. The unadjusted jet nozzles 150*a* are jet nozzles where the first and second draft angles 214, 216 can be, by way of non-limiting example, 0.5 degrees or less. A jet z-angle 240 can be measured from the direction of the unadjusted jet spray 154*a* to the perpendicular reference line 232. As illustrated in this example, the jet z-angle 240 of the unadjusted jet nozzle 150*a* is approximately 23 degrees. The jet z-angle 240 illustrates that the unadjusted jet spray 154*a* can be at least in part, in the same direction as the flow direction 166.

The jet z-angle 240 is relatively close to zero (less than 10 degrees) for the jet nozzles 150 in which the first and second draft angles 214, 216 at a predetermined value greater than 0.5 degrees. It is contemplated that the first and second draft angles 214, 216 can be between 0.5 degrees and 20 degrees depending, at least in part, on anticipated water pressure. For example, in order to accommodate an anticipated water pressure between X and Y, the first and second draft angles 214, 216 can be between 5 degrees and 10 degrees. Once the first and second draft angles 214, 216 are established, the jet spray 154 is close to perpendicular to the sprayer 130 or parallel to the corresponding perpendicular reference line 232. Alternatively, the nozzle tip 226 can contribute to the jet z-angle 240 having a relatively small value (less than 10 degrees).

Optionally, a modified jet nozzle 150*b* can include predetermined values for the first and second draft angles 214, 216 to intentionally provide a modified jet spray 154*b* where the jet z-angle 240 can be thought of as, for example, negative 20 degrees. It is important to note that the jet z-angle 240 of the modified jet nozzle 150*b* results in the modified jet spray 154*b*, at least in part, in the opposite direction of the flow direction 166.

The underlying physical phenomenon for controlling both the fan and jet z-angle can be thought of in terms of the velocity direction of the liquid. The liquid flows in the direction of an arrow that indicates the flow direction 166 through the sprayer 130, absent any structure controlling the velocity of the liquid, the liquid exiting an opening in either a fan spray nozzle or a jet nozzle will have a large velocity component still in line with the flow direction 166. Thus, even though an opening in the wall of the sprayer 130 for either of the fan or jet nozzles is perpendicular to the flow direction 166, the thickness of the sprayer alone is insufficient to completely change the direction of the liquid and the liquid emitted out either the fan or jet nozzle and the liquid still has a large directional component in the flow direction 166. It has been found that the height of the rib 170 and the height of the nozzle tip 226 can be selected to provide sufficient structure to change the direction of the vector for the emitted. In this sense the height of the rib 170 and the nozzle tip 226 can be specifically selected to control the z-angle for each of the fan spay nozzles and the jet nozzles. Of particular note for the fan spray nozzle, locating the rib 170 upstream of the outlet, as compared to downstream of the outlet, provided much greater efficacy in controlling the z-angle. Of particular note for the jet spray nozzle, the draft angle has been found to aid in controlling the z-angle. The greater the draft angle, the greater the effect on the direction of the velocity. Thus, draft angle can be used instead of or in combination with height to adjust the z-angle of the jet spray nozzles.

Figure 8:
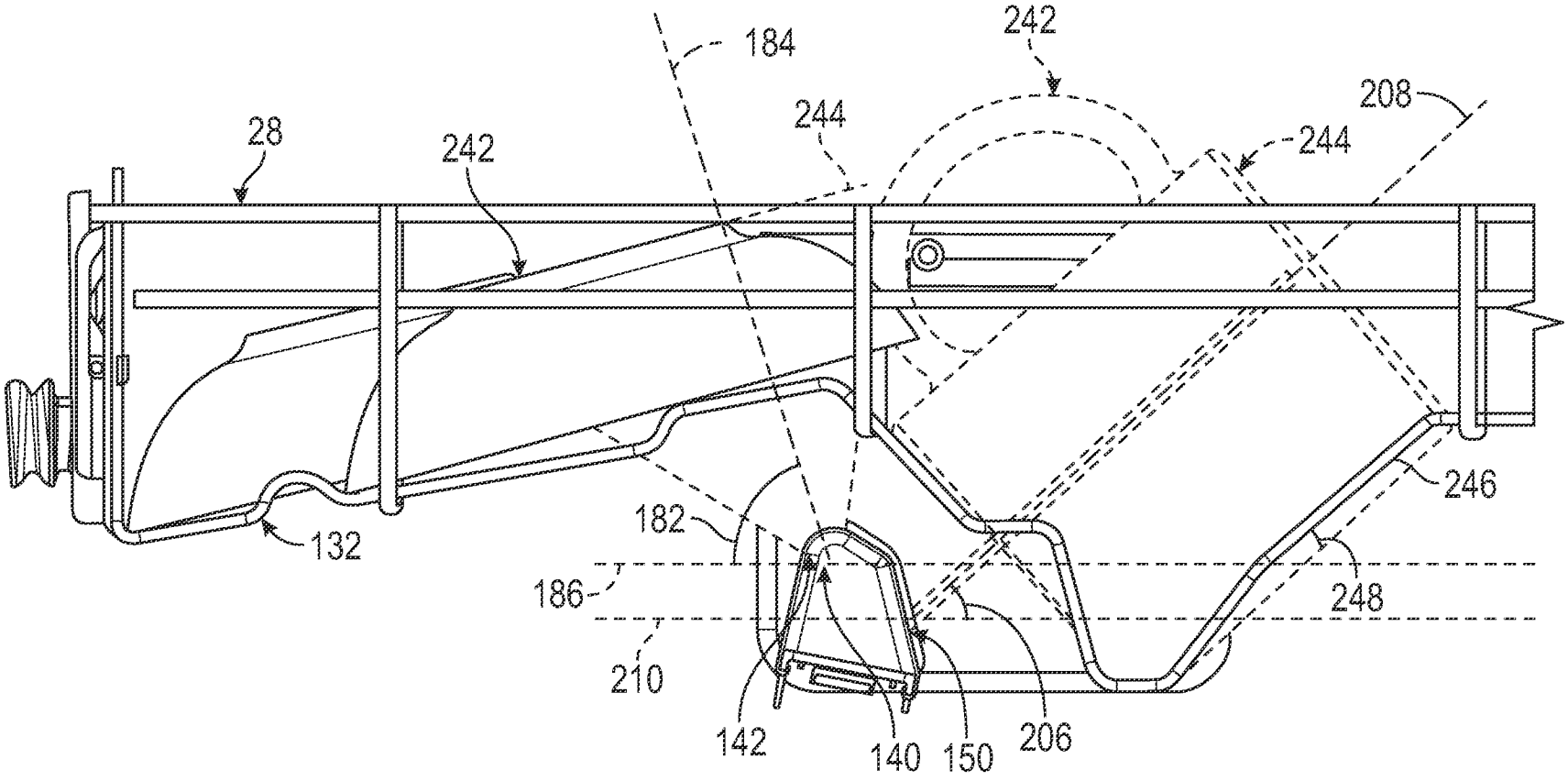
FIG. 8 is a partial front view of the dish holder and the sprayer of FIG. 4 further including dishes.

FIG. 8 illustrates dishes 242 in the dish holder 28 where different angles are selected to focus on discrete areas of the dish holder 28. In operation, the recirculation system 50 can fluidly connect to the hollow interior 162 of the sprayer 130. The liquid provided by the recirculation system 50 can flow through the hollow interior 162 or inlet end 164 in the direction of the flow direction 166.

The rib 170 changes the velocity of the liquid so that when the liquid exits the hollow interior 162 via the set of fan spray nozzles 140, the fan z-angle 230 is less than 10 degrees. The slot 142 is deigned to contribute to the fan spray y-angle 182, so that the fan spray centerline 184 is generally perpendicular to a base plane 244 of the dishes 242. Having the fan t-angle 230 less than 10 degrees and the fan spray y-angle 182 generally perpendicular to the base plane 244 of the dishes 242 allows the fan spray 144 to effectively clean the dishes 242. It is contemplated that the fan spray y-angle 182 can be any value such that the fan spray centerline 184 falls within the dishes 242.

Additionally, or alternatively, the sprayer 130 includes the set of jet nozzles 150. The jet z-angle 240 is less than 10 degrees for the set of jet nozzles 150. The jet z-angle 240 less than 10 degrees can be the result predetermined values for the first and second draft angles 214, 216. Additionally, or alternatively, the jet z-angle 240 less than 10 degrees can be a result of predetermined values for the first jet height 222 or the second jet height 224 of the nozzle tip 226.

The jet y-angle 206 directs the jet spray 154 so that the jet centerline 208 is generally perpendicular to the base plane 244 of the dishes 242. It is contemplated that the jet y-angle 206 can be any value such that the jet centerline 208 falls within the dishes 242.

It is contemplated that the jet y-angle 206 guides the jet spray 154 so that the jet centerline 208 is generally parallel to one or more support wire frame elements 246. A tine angle 248 can be established between the one or more support wire frame elements 246 and a horizontal reference line such as, but not limited to, the fan spray reference line 186. The jet y-angle 206 can be within ten degrees of the tine angle 248.

Having the jet z-angle 240 is less than 10 degrees and the jet y-angle 206 directs the jet spray 154 so that the jet centerline 208 is generally perpendicular to the base plane 244 of the dishes 242, allows the set of jet nozzles 150 it effectively clean the dishes 242.

The fan spray y-angle 182, the jet y-angle 206, the fan z-angle 230, and the jet t-angle 240 are measured during a cycle of operation.

Advantages of aspects of the present disclosure include an improved spray pattern in which the spray more directly strikes the dishes.

Another advantage is the control of the y-angle and the z-angle of the nozzles to so that spray can be directed in desired locations. This can enhance zone washing and ensure that liquid is reaching predetermined locations within the dishwasher.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher comprising:

a treating chamber for treating dishes;

at least one dish holder located within the treating chamber;

a stationary sprayer emitting liquid into the treating chamber from a hollow interior defined at least in part by a manifold, the stationary sprayer comprising a set of jet spray nozzles provided on the stationary sprayer with at least some of the jet spray nozzles in the set of jet spray nozzles having different geometries wherein the different geometries of the jet spray nozzles emit a jet spray at different angles relative to the stationary sprayer; and a recirculation circuit fluidly coupling the treating chamber to the stationary sprayer to recirculate liquid from the treating chamber to the stationary sprayer.

2. The dishwasher of claim 1, wherein each jet sprayer nozzle of the set ofj et spray nozzles includes a jet passage defined by a jet nozzle inlet, a first jet side, a second jet side, and a jet nozzle outlet.

3. The dishwasher of claim 2, wherein the second jet side and a tube wall intercept at a curved jet corner.

4. The dishwasher of claim 3, wherein the curved jet corner has a radius of curvature of 0.4 millimeters or less.

5. The dishwasher of claim 3, wherein the first jet side and the tube wall intercept at a sharp jet corner.

6. The dishwasher of claim 1, wherein the at least some of the set of jet spray nozzles include a draft angle.

7. The dishwasher of claim 6, wherein the draft angle is between 0.5 and 20 degrees.

8. The dishwasher of claim 6, wherein the draft angle is between 5 and 10 degrees.

9. The dishwasher of claim 2, wherein the at least some of the set of jet spray nozzles include a first draft angle measured from the first jet side to a first draft reference line, wherein the first draft reference line is perpendicular to the jet nozzle outlet.

10. The dishwasher of claim 9, wherein the at least some of the set of jet spray nozzles further include a second draft angle measured from the second jet side to a second draft reference line, wherein the second draft reference line is perpendicular to the jet nozzle outlet or parallel to the first draft reference line.

11. The dishwasher of claim 10, wherein the first draft angle or the second draft angle is between 0.5 degrees and 20 degrees.

12. The dishwasher of claim 10, wherein the measure of the first draft angle is different than the measure of the second draft angle.

13. The dishwasher of claim 10, wherein the at least some of the set of jet spray nozzles includes at least a first jet spray nozzle and a second jet spray nozzle, wherein a Z-angle is 90 degrees.

14. The dishwasher of claim 1, wherein at least some of the set of jet spray nozzles comprise a nozzle tip having an outlet, with the nozzle tip having a corresponding height controlling the angle at which spray is emitted from the nozzle tip into the treating chamber.

15. The dishwasher of claim 14, wherein the height of the nozzle tip for different jet spray nozzles vary.

16. The dishwasher of claim 1, wherein at least some of the set of jet spray nozzles are shapes as truncated cones or multi-sided pyramids.

17. The dishwasher of claim 1, wherein the stationary sprayer further comprises a set of fan spray nozzles emitting liquid into the treating chamber from the hollow interior.

18. The dishwasher of claim 17, wherein the set of fan spray nozzles are located at a high point of the manifold and the set of jet spray nozzles are located along a side portion of the manifold.

19. The dishwasher of claim 18, wherein the set of fan spray nozzles provide a fan spray that is in a different direction than a jet spray provided by the set of j et spray nozzles.

20. The dishwasher of claim 1, wherein the stationary sprayer underlies the at least one dish holder.

* * * * *